US006547986B1

(12) United States Patent
Kintz et al.

(10) Patent No.: US 6,547,986 B1
(45) Date of Patent: Apr. 15, 2003

(54) MAGNETORHEOLOGICAL GREASE COMPOSITION

(75) Inventors: K. Andrew Kintz, Apex, NC (US); J. David Carlson, Cary, NC (US); Beth C. Munoz, Oceanside, CA (US); Julia D. Sessoms, Raleigh, NC (US)

(73) Assignee: Lord Corporation, Cary, NC (US)

( * ) Notice: Subject to any disclaimer, the term of this patent is extended or adjusted under 35 U.S.C. 154(b) by 0 days.

(21) Appl. No.: 09/666,239

(22) Filed: Sep. 21, 2000

(51) Int. Cl.[7] ..... H01R 1/22
(52) U.S. Cl. ..... 252/212.52
(58) Field of Search ..... 252/212.52

(56) References Cited

U.S. PATENT DOCUMENTS

| | | | | |
|---|---|---|---|---|
| 2,661,825 A | | 12/1953 | Winslow | 192/21.5 |
| 2,667,237 A | * | 1/1954 | Rabinow | 137/909 |
| 2,751,352 A | | 6/1956 | Bondi | 252/62.5 |
| 2,859,181 A | * | 11/1958 | Jordan et al. | 252/62.52 |
| 3,006,656 A | | 10/1961 | Schaub | 280/112 |
| 3,385,793 A | | 5/1968 | Klass et al. | 252/75 |
| 4,992,190 A | | 2/1991 | Shtarkman | 252/62.52 |
| 5,382,373 A | | 1/1995 | Carlson | 252/62.55 |
| 5,645,752 A | | 7/1997 | Weiss et al. | 252/62.54 |

FOREIGN PATENT DOCUMENTS

WO 98/37339 8/1998

WO WO 98/37339 * 8/1998

OTHER PUBLICATIONS

"Standard Test Methods for Cone Penetration of Lubricating Grease," *ASTM D 217—94*, American Society for Testing and Materials.

Carlson, J.D., "Low–Cost MR Fluid Devices," *Actuator 98*, 6th International Conference on New Actuators, Jun. 17–19, 1998, Bremen Germany, 417–421.

Carlson, J.D., "Low–Cost MR Fluid Sponge Devices," Proceedings of the 7th International Conference on ER Fluids and MR Suspension, Honolulu, Jul. 19–23, 1999, R. Tao, Ed., World Scientific, Singapore (2000) pp. 621–628. No month.

Carlson, J.D., New, Cost Effective Braking, Damping, and Vibration Control Devices Made with Magnetorheological Fluids,*Materials Technology*, 13(3):96–99 (1998). No month.

German, R. M., "Powder Fabrication", *Powder Metallurgy Science*, 2nd Ed., (3):107–110 1984, 1999.

* cited by examiner

*Primary Examiner*—C. Melissa Koslow
(74) *Attorney, Agent, or Firm*—Miles B. Dearth

(57) ABSTRACT

The invention provides a magnetorheological grease composition which contains magnetic-responsive particles, a carrier fluid and a thickening agent. The composition according to the invention contains an effective amount of thickening agent to provide a composition of proper consistency with good properties and little settling of the magnetic-responsive particles.

26 Claims, No Drawings

MAGNETORHEOLOGICAL GREASE COMPOSITION

FIELD OF THE INVENTION

The invention relates to magnetorheological grease compositions which have increased resistance to settling, wear, corrosion and oxidation. More specifically, the present invention relates to magnetorheological grease compositions that utilize high concentrations of thickening agents.

BACKGROUND OF THE INVENTION

Magnetorheological compositions typically include micron-sized magnetic-responsive particles. In the presence of a magnetic field, the magnetic-responsive particles become polarized and are thereby organized into chains of particles or particle fibrils. The particle chains increase the apparent viscosity (flow resistance) of the fluid, resulting in the development of a solid mass having a yield stress that must be exceeded to induce onset of flow of the magnetorheological fluid. The particles return to an unorganized state when the magnetic field is removed, which lowers the viscosity of the magnetorheological composition.

Magnetorheological compositions are responsive to a magnetic field, and exhibit controllable behavior accordingly. However, many magnetorheological materials suffer from excessive gravitational particle settling which can interfere with the magnetorheological activity of the material due to non-uniform particle distribution. One cause of gravitational particle settling in magnetorheological materials is the large difference between the specific gravity of the magnetic particles and that of the carrier fluid which can cause rapid particle settling in a magnetorheological material.

U.S. Pat. No. 5,645,752 discloses a magnetorheological material which contains a thixotropic additive to provide stability against particle settling. An optional colloidal additive may be utilized in combination with the thixotropic agent in order to facilitate the formation of a thixotropic network.

U.S. Pat. No. 5,382,373 relates to a magnetorheological material that utilizes a particle component which is capable of independently increasing the yield stress of the overall magnetorheological material. A surfactant to disperse the particle component may be optionally utilized. The surfactant, if utilized, is preferably a hydrophobic fumed silica, a "dried" precipitated silica gel, a phosphate ester, a fluoroaliphatic polymeric ester, or a coupling agent which is used in an amount ranging from about 0.1 to 20 percent by weight relative to the weight of the particle component.

U.S. Pat. No. 4,992,190 discloses a magnetic fluid composition that is responsive to a magnetic field. The fluid composition comprises a vehicle, solid magnetizable particles suspended in the vehicle, and a silica gel dispersant. An additional surfactant may be employed to impart thixotropic properties.

U.S. Pat. No. 2,661,825 describes an apparatus capable of controlling the slippage between moving parts through the use of magnetic or electric fields. The space between the moveable parts is filled with a field responsive medium. The development of a magnetic or electric field flux through this medium results in control of resulting slippage. A fluid responsive to the application of a magnetic field is described to contain carbonyl iron powder and light weight mineral oil.

U.S. Pat. No. 3,385,793 relates to an electroviscous fluid which contains a conductive material. The fluid includes silica gel and silicone oil, which functions as a vehicle. The fluid can also contain iron particles disclosed to function as a conductive agent. The composition is not described as one responsive to an electromagnetic field.

U.S. Pat. No. 3,006,656 relates to a magnetic material for shock absorbers, which comprises carbonyl iron powder, and an additive such as oil, kerosene, benzene, graphite, chalk, mica, soapstone, a silicone, and glycerine.

U.S. Pat. No. 2,751,352 describes a magnetic fluid for a clutch or like apparatus, which may comprise iron powder, organic lubricants as a base carrier and an oleophobic-ferrophilic liquid dispersant.

Magnetorheological technology is useful in devices or systems for controlling vibration and/or noise. However, magnetorheological fluids commonly have such low viscosity that an o-ring or other type of fluid sealing mechanism is required to seal the magnetorheological fluids within the devices. Magnetorheological devices may require precisely toleranced components, expensive seals, expensive bearings, and relatively large volumes of magnetically controllable fluid. The costs associated with such devices may be prohibitive to their use in certain applications.

Moreover, the use of low viscosity magnetorheological fluids requires high efficiency during the mixing of the magnetorheological fluids so as to avoid the settling problems introduced by the high specific gravity of the metallic magnetic particles.

A need exists in the art, therefore, for a magnetorheological grease composition which has a high enough consistency to remain in the device without the aid of a sealing mechanism. There is further a need in the art for a magnetorheological grease composition with resistance to settling of the magnetic particles. There also is a need in the art for a magnetorheological composition that is resistant to wear and oxidation. This invention provides such a composition.

SUMMARY OF THE INVENTION

The magnetorheological compositions according to the present invention comprise magnetic-responsive particles, a carrier fluid and at least one thickening agent, wherein the thickening agent is employed in a substantially effective amount to form a grease-like consistency. Preferably, the thickening agent is present in an amount ranging from about 30 to 90 percent by volume relative to the total volume of the magnetorheological grease composition.

In one aspect, the magnetorheological grease compositions according to the present invention comprise magnetic-responsive particles, a carrier fluid and at least one thickening agent, wherein the grease composition has a NLGI consistency number between about 00 and about 4.

In another aspect, the magnetorheological grease composition of the invention comprises magnetic-responsive particles, a carrier fluid and at least one thickening agent wherein the thickening agent provides the composition with a consistency effective to allow the composition to maintain a position within a magnetorheological device.

The magnetorheological grease compositions of the invention exhibit excellent resistance to settling and wear because of a substantially increased concentration of the thickening agents in the magnetorheological grease compositions.

DETAILED DESCRIPTION OF THE INVENTION

"Force output" as used herein means the damping force, torque, braking force or similar force depending on the device. "Yield strength" is the force required to exceed the yield stress. The "yield stress" is the stress that must be exceeded to induce onset of flow of the magnetorheological composition when subject to the presence of a magnetic field or in the "on-state." The absence of a magnetic field is referred to herein as the "off-state." "On-state forces" as used herein are the resultant forces of a device as a result of applying a magnetic field. "Off-state forces" means the forces generated by a device when no magnetic field is applied.

The present invention relates to a magnetorheological grease composition which comprises magnetic-responsive particles, a carrier fluid and at least one thickening agent. The thickening agent may be provided in an amount effective to produce a gel-like structure for the grease composition. The gel structure provides sufficient consistency to enable the grease composition to maintain its position in a magnetorheological device during its use in such a magnetorheological device. The term "grease" as used herein means a semi-fluid to solid product of a dispersion of a thickener in a carrier fluid. The term "thickener" means a substance dispersed in a carrier fluid to form the product's structure. "Consistency" means the degree of resistance to movement under stress and can be measured according to ASTM D 217 which provides standard test methods for cone penetration of lubricating grease. ASTM D 217 sets forth the National Lubricating Grease Institute's classification of greases according to their consistency as measured by the worked penetration, a test explained in the ASTM standard.

The grease composition of the present invention has sufficient consistency to be utilized without the need for a sealing mechanism to keep the magnetorheological composition confined within the appropriate space in a magnetorheological device. This means that certain apparatus previously needed in the structure of a magnetorheological device may no longer be needed, such as bearings, volume compensators or precision mechanical tolerances. Generally, the NLGI consistency number of the grease composition will be between about 00 and 4. In one aspect of the invention, the NLGI consistency number is between about 0 and about 2. In terms of viscosity, the grease compositions of the invention generally will have a viscosity greater than about 1000 centipoise at 25° C.

The thickening agents which may be employed in the compositions of this invention include a wide variety of organic thickening agents and inorganic thickening agents. The organic thickening agents of this invention include various metal soaps, metal soap complexes and organic metal salts as well as nonmetallic organic thickening agents such as the polyureas, and mixtures thereof. Other thickeners include organoclays, associative polymers or polyacrylate associative thickeners, such as Acrysol® by Rohm and Haas and Alcogum® by Alco Chemicals, polyelectrolytes, polysaccharides, phospholipids and polycarboxylates, and mixtures thereof. Inorganic thickening agents suitable for this invention include inorganic solids such as metal oxides, silica, precipitated silica, fumed silica, aluminum oxide, carbon black, talc, graphite and fibers, and mixtures thereof.

The thickening agents in one aspect of the present invention include carboxylate soaps, complexes such as lithium complexes or calcium complex stearate, bentonite and hectorite organoclays, hydrophobically modified alkali soluble acrylic copolymers, hydrophobically modified ethylene-oxide-based urethane block copolymers, hydrophobically modified ethoxylate-urethane alkali swellable/soluble emulsion, metal oxides, precipitated silica, fumed silica, aluminum oxide, carbon black, talc, graphite, fibers, polyureas, styrene divinylbenzene copolymer matrix, methacrylic acid divinylbenzene, hydroxyethyl cellulose, phospholipids, polycarboxylates, and mixtures thereof. Particularly preferred thickening agents are precipitated silica and fumed silica.

Examples of the preferred carboxylate soaps of the invention include sodium stearate, calcium stearate, lithium stearate, potassium stearate, zinc stearate, strontium stearate, aluminum stearate, barium stearate, magnesium stearate, and mixtures thereof.

Suitable thickening agents of the invention are available from Rheox, Inc. under the trade names of Baragel®, Bentone®, Nykon®, Nalzin®; available from Union Carbide under the trade name UCAR Polyphobe®; and available from Rohm and Haas Company under the trade name Acrysol®.

The thickening agent generally will be used in an amount effective to produce a composition with a grease-like consistency. The amount of thickening agent generally will be sufficient to allow the composition to maintain a desired position within a magnetorheological device. The thickening agent may be used in an amount effective to produce a composition with a desired NLGI consistency number. The concentration of thickening agent needed will depend on the particular agent used and the amount necessary to end up with a desired NLGI consistency number. The thickening agent generally will be used in an amount between about 30% to about 90% by volume of the total magnetorheological grease composition. In one aspect of the invention, the thickening agent will be used in an amount of from about 50% to about 85% by volume of the total magnetorheological grease composition.

The magnetic-responsive particles useful in the present invention may be any solid known to exhibit magnetorheological activity. Typical particle components useful in the present invention are comprised of, for example, paramagnetic, superparamagnetic or ferromagnetic compounds. Specific examples of magnetic-responsive particles which may be used include particles comprised of materials such as iron, iron alloys, iron oxide, iron nitride, iron carbide, carbonyl iron, chromium dioxide, low carbon steel, silicon steel, nickel, cobalt, and mixtures thereof. The iron oxide includes all known pure iron oxides, such as $Fe_2O_3$ and $Fe_3O_4$, as well as those containing small amounts of other elements, such as manganese, zinc or barium. Specific examples of iron oxide include ferrites and magnetites. In addition, the magnetic-responsive particle component can be comprised of any of the known alloys of iron, such as those containing aluminum, silicon, cobalt, nickel, vanadium, molybdenum, chromium, tungsten, manganese and/or copper.

Iron alloys which may be used as the magnetic-responsive particles in the present invention include iron-cobalt and iron-nickel alloys. The iron-cobalt alloys preferred for use in the magnetorheological compositions have an iron:cobalt ratio ranging from about 30:70 to 95:5, and preferably from about 50:50 to 85:15, while the iron-nickel alloys have an iron-nickel ratio ranging from about 90:10 to 99:1, and preferably from about 94:6 to 97:3. The iron alloys may contain a small amount of other elements, such as vanadium, chromium, etc., in order to improve the ductility and mechanical properties of the alloys. These other elements are typically present in an amount that is less than about 3.0% by weight.

The magnetic-responsive particles of the invention are typically in the form of a metal powder which can be prepared by processes which are well known to those skilled in the art. Typical methods for the preparation of metal powders include water atomization, reduction of metal oxides, grinding or attrition, electrolytic deposition, metal carbonyl decomposition, rapid solidification, or smelt processing. The particles may be spherical or may vary from spherical such as irregularly shaped particles or ellipsoidal particles.

In one aspect of the invention, the magnetic-responsive particles are particles with a high iron content, generally greater than or at least about 95% iron. Preferably, the magnetic-responsive particles used will have less than about 0.01% carbon. In an especially preferred embodiment, the magnetic-responsive particles will contain about 98% to about 99% iron, and less than about 1% oxygen and nitrogen. Such particles may be obtained, for example, by water atomization or gas atomization of molten iron. Iron particles with these characteristics are commercially available. Water atomization contributes to reduce the total cost of a magnetorheological grease composition according to the present invention. Water atomization is described in *Powder Metallurgy Science* by Randall M. German, $2^{nd}$ Ed., Chap. 3, "Powder Fabrication," pp.107–110 (© 1984, 1999), as the most common technique for producing elemental and alloy powders from metals which melt below approximately 1600° C. This method involves directing high pressure water jets against the melt stream, forcing disintegration and rapid solidification.

Examples of magnetic-responsive particles useful in the present invention include Hoeaganes FPI, 1001 HP and ATW230, along with carbonyl iron particles such as ISP R2430 and 1640. Other useful particles include stainless steel powders such as 430L and 410L.

The particle size of the magnetic-responsive particles should be selected so that it exhibits multi-domain characteristics when subjected to a magnetic field. The use of a thickening agent as taught herein enables the use of larger particles than are typically used in magnetorheological compositions. The average number particle diameter distribution for the magnetic-responsive particles is generally between about 0.1 and about 500 microns, preferably between about 1 and about 100 microns. In the most preferred embodiment, the average number particle diameter distribution of the magnetic-responsive powder is about 3 to about 50 microns. The particle component may contain magnetic-responsive particles of a variety of sizes, so long as the average number particle diameter distribution is as set forth. The size of the magnetic-responsive particles may be determined by scanning electron microscopy, a laser light scattering technique or measured using various sieves, providing a particular mesh size.

The magnetic-responsive particles may be present in the magnetorheological grease composition in an amount of, as measured by volume, about 5% to about 50%, preferably about 20% to about 45% by volume.

The carrier component is a fluid that forms the continuous phase of the magnetorheological grease composition. The carrier fluid used to form a magnetorheological composition according to the invention may be any of the vehicles or carrier fluids known for use with magnetorheological materials. In the preferred embodiment, the carrier fluid will be an organic fluid, or an oil-based fluid. Suitable carrier fluids which may be used include natural fatty oils, mineral oils, polyphenylethers, dibasic acid esters, neopentylpolyol esters, phosphate esters, synthetic cycloparaffins and synthetic paraffins, unsaturated hydrocarbon oils, monobasic acid esters, glycol esters and ethers, silicate esters, silicone oils, silicone copolymers, synthetic hydrocarbons, perfluorinated polyethers and esters and halogenated hydrocarbons, and mixtures or blends thereof. Hydrocarbons, such as mineral oils, paraffins, cycloparaffins (also known as naphthenic oils) and synthetic hydrocarbons are the preferred classes of carrier fluids. The synthetic hydrocarbon oils include those oils derived from oligomerization of olefins such as polybutenes and oils derived from high alpha olefins of from 8 to 20 carbon atoms by acid catalyzed dimerization and by oligomerization using trialuminum alkyls as catalysts. Such poly-α-olefin oils are particularly preferred carrier fluids. Carrier fluids appropriate to the present invention may be prepared by methods well known in the art and many are commercially available, such as Durasyn PAO and Chevron Synfluid PAO.

The carrier component may be a mixture of any of these classes of fluids. The preferred carrier component is non-volatile, non-polar and does not include any substantial amount of water. The carrier fluid of the present invention is typically utilized in an amount ranging from about 5 to about 65, preferably from about 15 to 45, percent by volume of the total magnetorheological grease composition.

The magnetorheological grease composition optionally includes other components such as an antioxidant, a lubricant and a viscosity modifier, and mixtures thereof, among others. Such optional components are known to those of skill in the art. Examples of antioxidants include metal and nonmetal dithiophosphates, hindered phenols, aromatic amines, and sulfurized phenols, among others. Examples of lubricants include organic fatty acids and amides, lard oil, and high molecular weight organic phosphorus and phosphoric acid esters and examples of viscosity modifiers include polymers and copolymers of olefins, methacrylates, dienes or alkylated styrenes. Which of these components would be useful in a particular application will be determined by that application of the magnetorheological grease composition. If present, the amount of these optional components typically ranges from about 0.25 to about 10 volume percent, based on the total volume of the magnetorheological composition. Preferably, the optional ingredient or ingredients will be present in the range of about 0.5 to about 7.5 volume percent based on the total volume of the magnetorheological grease composition.

Other additional additives may also be utilized in the present invention to give the magnetorheological grease desired properties. These additives include corrosion inhibitors, antiwear additives, friction modifiers, viscosity index improvers, metal deactivators, dispersants, extreme pressure additives, surfactants or mixtures thereof, etc. Examples of antiwear additives include metal and non-metal dialkyldithio carbamates such as zinc dipropyldithiocarbamate or methylene bis dibutyl dithiocarbamate. The friction modifier may be molybdenum disulfide or an organomolybdenum. The viscosity index improvers, useful in decreasing the change in viscosity of the magnetorheological composition with temperature, may be low molecular weight polymers, among others. The additives used in a particular grease composition will depend on the application for which the grease composition is intended.

The magnetorheological grease compositions of the present invention may be used in a number of devices, including brakes, pistons, clutches, dampers, exercise equipment, toys, controllable composite structures and structural elements. The compositions of the invention are most useful in applications where a low cost magnetorheological composition with high yield forces and no settling is required. For example, the magnetorheological grease compositions of the present invention would be useful for earthquake dampers which require long-term stability.

In one aspect, the magnetorheological grease compositions of the invention are used in sponge technology devices, such as sponge dampers. As used herein, "sponge devices" means a device wherein the magnetorheological fluid or grease is held in place by means of a secondary supporting matrix called a sponge. The magnetorheological composition is selected to provide maximum dropping point yet provide shear thinning behavior when in use in a device. Magnetorheological materials used in sponge applications need minimal settling and a maximum yield stress when subjected to a magnetic field. Such devices are described, for example, in Carlson, "Low-Cost MR Fluid Devices," *Actuator* 98, $6^{th}$ International Conference on New Actuators, Jun. 17–19, 1998, Bremen, Germany, pp. 417–421; J. D. Carlson, "Low-Cost MR Fluid Sponge Devices", Proceedings of the 7th International Conference on ER Fluids and MR Suspensions, Honolulu, Jul. 19–23, 1999, R. Tao, editor, World Scientific, Singapore (2000) pp. 621–628; and J. David Carlson, "New Cost Effective Braking, Damping, and Vibration Control Devices Made with Magnetorheological Fluid", *Materials Technology,* 13/3 (1998) 96–99.

In one aspect of the invention, large particle, water atomized iron may be used in a sponge magnetorheological device. Use of this type of iron provides for thicker magnetorheological grease compositions as a result of the larger particle size and allows for a lower cost formulation. For example, water atomized iron particles supplied by Hoeganaes Corporation under the name Anchorsteel FPI have been found useful for this application. This powder is designed to have a maximum particle packing fraction with a particle size distribution less than 44 microns. This powder is very low in carbon content to aid in device wear. The water atomization process has been optimized to provide generally regular shaped particles to improve packing. Other magnetic-responsive particles also may be used.

In one aspect of the present invention, a magnetorheological sponge device is provided wherein water atomized iron particles are used in conjunction with a carrier fluid and a thickening agent which is based on synthetic hydrocarbon oils and a metal stearate. One thickening agent which may be used for such applications is Nebula EP grease provided by Exxon Corporation which is a calcium complex stearate based on synthetic hydrocarbon oils.

The grease compositions of the present invention can be made by any of a variety of conventional mixing methods in equipment known for such use. For example, the magnetic-responsive particles can be charged into the thickening agent in increments with addition of the carrier fluid during or after all of the magnetic-responsive particles have been charged into the thickening agent. The resulting mixture should be substantially smooth and homogeneous.

Examples of the magnetorheological grease compositions of the invention were prepared as follows. These examples are provided to illustrate the present invention and should not be construed to limit the scope of the invention.

EXAMPLE 1

A magnetorheological grease composition was prepared by mixing 16 g of ISP carbonyl iron (R2430) with 4 g of Castrol Syntec grease, a lithium complex grease based on mineral oil with a NLGI consistency number of 2. The resulting composition has a NLGI consistency number of 3 and does not flow under its own weight yet shear thins. The formulation is homogeneous and smooth. This grease composition does not exhibit any signs of separation even after 3½ years.

EXAMPLE 2

A magnetorheological grease composition was prepared by mixing 16 g of ISP carbonyl iron (R2430), 2 g Castrol Syntec grease and 2 g Castrol Syntec oil (10W-30). The resulting composition had a NLGI consistency number of 1 and was homogeneous and smooth. After some months, this composition flowed to a more or less level surface in the bottle.

EXAMPLE 3

A magnetorheological grease composition was prepared by mixing 16 g of ISP carbonyl iron (R2430), 3 g Castrol Syntec grease and 1 g Castrol Syntec oil (10W-30). The resulting composition had a NLGI consistency number of 2 and was homogeneous and smooth.

EXAMPLE 4

A magnetorheological grease composition was prepared with the components as follows:

| | density (g/ml) | formula | volume (ml) | weight (g) | weight (%) |
|---|---|---|---|---|---|
| Anchorsteel FPI | 7.50 | 49.0% | 21.51 | 169.1 | 88.51% |
| Exxon Nebula EP00 | 0.99 | 45.50% | 19.97 | 20.0 | 10.46% |
| Durasyn 164 (polyαolefin) | 0.82 | 5.50% | 2.41 | 2.0 | 1.04% |

Nebula EP00 was charged into a medium weigh dish. Iron was then charged, in increments, into the dish, mixing after each with a spoon end of a metal spatula. After most of the iron was incorporated into the grease, it became too thick to mix. The oil was then charged into the rest of the mixture. The resulting mixture was transferred to a large glass watchglass and mixed and mashed until it was fairly smooth. The mixture looked like very thick brownie batter.

EXAMPLE 5

A magnetorheological grease composition according to the present invention was prepared having the following characteristics:

| | density (g/ml) | formula | volume (ml) | weight (g) | weight (%) |
|---|---|---|---|---|---|
| Anchorsteel FPI | 7.50 | 45.0% | 31.50 | 236.3 | 86.86% |
| Exxon Nebula EP00 | 0.99 | 35.5% | 24.50 | 24.3 | 8.92% |
| Durasyn 164 | 0.82 | 20.0% | 14.00 | 11.5 | 4.22% |

The Nebula EP00 was charged into a 125 ml stainless steel beaker. The iron was then charged into the beaker in increments, mixing after each addition. After three iron additions, the oil was charged into the beaker all at once and mixed to incorporate into the thick mixture in the beaker. The remaining iron was then charged in increments into the beaker. The mixture was then mixed for another 1–1½ minutes, for a total mixing time of 8 minutes.

EXAMPLE 6

A magnetorheological grease composition was prepared as in Example 5 having the following characteristics:

| | density (g/ml) | formula | volume (ml) | weight (g) | weight (%) |
|---|---|---|---|---|---|
| ISP 2430 | 7.86 | 45.0% | 31.50 | 236.3 | 86.67% |
| Exxon Nebula EP00 | 0.99 | 40.0% | 28.00 | 27.7 | 10.17% |
| Durasyn 164 | 0.82 | 15.0% | 10.50 | 8.6 | 3.16% |

This grease composition had a viscosity at a shear rate of 40.33 $s^{-1}$ of 11,308 centipoise and a viscosity at a shear rate of 10.75 $s^{-1}$ of 24,372 centipoise.

EXAMPLE 7

A magnetorheological grease composition was prepared having the following characteristics:

| | density (g/ml) | formula | volume (ml) | weight (g) | weight (%) |
|---|---|---|---|---|---|
| Anchorsteel FPI | 7.50 | 45.0% | 540.00 | 4050.0 | 86.58% |
| Exxon Nebula EP00 | 0.99 | 40.0% | 480.00 | 480.0 | 10.26% |
| Durasyn 164 | 0.82 | 15.0% | 180.00 | 147.6 | 3.16% |

The Nebula EP00 was charged into a 2L stainless steel beaker. The iron was then charged into the beaker about every 1½ minutes starting at 30 mix speed (Variac setting for Premier Lab Dispersator) and increasing to 35 after three minutes, 40 after 4½ minutes and 45 after 6 minutes 10 seconds (3500 rpm). The beaker was scraped at 7 minutes, 30 seconds when about half of the iron was in the beaker. About ½ the oil was then charged into the beaker before charging the remaining iron into the beaker by mixing for one minute, 30 seconds at a setting of 45 and then increasing to a setting of 50 for 10 minutes, 45 seconds. The remaining oil was charged into the beaker at 12 minutes, while the iron was charged into the beaker at 13 minutes, 30 seconds, 15 minutes, and 16 minutes, 30 seconds. The beaker was scraped at 18 minutes and the setting was increased to 55. The remaining iron was charged into the beaker with all of it in by 19 minutes, 30 seconds of mixing. The beaker was scraped at 20 minutes, 30 seconds at 43° C. and then set into an ice/water bath. The mixture was mixed for another five minutes on a setting of 55 which was increased to 60 for the last two minutes. The rpm fluctuated from 4400 to 5400 during the last two minutes at the setting of 60.

While the invention has been described in detail and with reference to specific embodiments thereof, it will be apparent to one skilled in the art that various changes and modifications can be made without departing from the spirit and scope thereof.

We claim:

1. A magnetorheological grease composition comprising:

magnetic-responsive particles;

a carrier fluid; and at least one thickening agent selected from the group consisting of sodium stearate, calcium stearate, lithium stearate, potassium stearate, zinc stearate, strontium stearate, aluminum stearate, barium stearate, magnesium stearate, precipitated silica and fumed silica, and mixtures thereof, wherein the total amount of thickening agent is between about 30 and about 90 percent by volume relative to the total volume of the magnetorheological grease composition.

2. The magnetorheological grease composition according to claim 1 wherein the magnetic-responsive particles have an average number particle diameter distribution ranging from about 0.1 to about 500 microns.

3. The magnetorheological grease composition according to claim 1 wherein the carrier fluid comprises at least one fluid selected from the group consisting of natural fatty oils, mineral oils, polyphenylethers, dibasic acid esters, neopentylpolyol esters, phosphate esters, synthetic cycloparaffins, synthetic paraffins, unsaturated hydrocarbon oils, monobasic acid esters, glycol esters, glycol ethers, silicate esters, silicone oils, silicone copolymers, synthetic hydrocarbons, perfluorinated polyethers and esters and halogenated hydrocarbons, and mixtures or blends thereof.

4. A magnetorheological grease composition according to claim 3 wherein the carrier fluid is mineral oil, paraffin oil, cycloparaffin oil, synthetic hydrocarbon oil or mixtures thereof.

5. A magnetorheological grease composition according to claim 1 wherein the carrier fluid comprises a synthetic hydrocarbon oil derived from poly-α-olefin.

6. The magnetorheological grease composition according to claim 1 further comprising an antioxidant, a lubricant, a viscosity modifier, or a combination thereof.

7. The magnetorheological grease composition of claim 1 wherein said magnetic-responsive particles are present in an amount of about 5 to about 50% by weight of the total magnetorheological composition; and said carrier fluid is present in an amount of about 5 to about 65 percent by volume of the total magnetorheological grease composition.

8. The magnetorheological grease composition of claim 1 wherein the magnetic-responsive particles are obtained by water atomization.

9. The magnetorheological grease composition of claim 1 wherein the magnetic-responsive particles are carbonyl iron.

10. The magnetorheological grease composition according to claim 1 wherein the NLGI consistency number of the composition is between about 00 and about 4.

11. The magnetorheological grease composition according to claim 1 wherein the NLGI consistency number is between about 0 and about 2.

12. A magnetorheological grease composition comprising:

carbonyl iron magnetic-responsive particles;

a carrier fluid; and at least one thickening agent, wherein the grease composition has a NLGI consistency number of between about 00 and about 4.

13. The magnetorheological grease composition according to claim 12 wherein the thickening agent is selected from the group consisting of metal soaps, metal soap complexes, organic metal salts, polyureas, organoclays, polyelectrolytes, polysaccharides, phospholipids, polycarboxylates, metal oxides, precipitated silica, fumed silica, aluminum oxide, carbon black, talc, graphite, fibers and mixtures thereof.

14. The magnetorheological grease composition of claim 12 further comprising an antioxidant, a lubricant, a viscosity modifier, or a combination thereof.

15. The magnetorheological grease composition according to claim 13 wherein the thickening agent comprises precipitated silica, fumed silica, a polyurea, an organoclay, a metal soap or a metal soap complex.

16. The magnetorheological grease composition according to claim 12 wherein the carrier fluid is mineral oil, paraffin oil, cycloparaffin oil, or synthetic hydrocarbon oil and the thickening agent is precipitated silica, fumed silica, a polyurea, an organoclay, a metal soap or a metal soap complex.

17. A magnetorheological grease composition comprising:

magnetic-responsive particles;

a hydrocarbon oil carrier fluid derived from poly-α-olefin; and at least one thickening agent, wherein the total amount of thickening agent is between about 30 and about 90 percent by volume relative to the total volume of the magnetorheological grease composition.

18. The magnetorheological grease composition according to claim 17 wherein the thickening agent is selected from the group consisting of metal soaps, metal soap complexes, organic metal salts, polyureas, organoclays, polyelectrolytes, polysaccharides, phospholipids, polycarboxylates, metal oxides, precipitated silica, fumed silica, aluminum oxide, carbon black, talc, graphite, fibers and mixtures thereof.

19. The magnetorheological grease composition according to claim 18 wherein the thickening agent comprises a polyurea, organoclay, metal soap, metal soap complex or mixtures thereof.

20. The magnetorheological grease composition according to claim 18 wherein the thickening agent is a carboxylate soap selected from the group consisting of sodium stearate, calcium stearate, lithium stearate, potassium stearate, zinc stearate, strontium stearate, aluminum stearate, barium stearate, magnesium stearate, and mixtures thereof.

21. The magnetorheological grease composition according to claim 18 wherein the thickening agent is precipitated silica or fumed silica.

22. The magnetorheological grease composition according to claim 17 wherein the thickening agent is precipitated silica, fumed silica, a polyurea, an organoclay, a metal soap or a metal soap complex.

23. The magnetorheological grease composition according to claim 17 wherein the thickening agent comprises precipitated silica, fumed silica, a polyurea, an organoclay, a metal soap or a metal soap complex.

24. The magnetorheological grease composition according to claim 17 wherein the magnetic-responsive particles have an average number particle diameter distribution between about 1 and about 100 microns and are obtained by water atomization.

25. A magnetorheological grease composition comprising:

magnetic-responsive particles;

a carrier fluid; and at least one thickening agent selected from the group consisting of precipitated silica and fumed silica, and mixtures thereof, wherein the total amount of thickening agent is between about 30 and about 90 percent by volume relative to the total volume of the magnetorheological grease composition.

26. A magnetorheological grease composition comprising:

carbonyl iron magnetic-responsive particles;

a synthetic hydrocarbon oil carrier fluid; and at least one thickening agent, wherein the grease composition has a NLGI consistency number of between about 00 and about 4.

* * * * *